United States Patent [19]

Owens et al.

[11] 4,003,320

[45] Jan. 18, 1977

[54] TABLE ASSEMBLY

[75] Inventors: Douglas F. Owens, Altoona; Thomas D. Aders, Birmingham, both of Ala.

[73] Assignee: Champion International Corporation, Stamford, Conn.

[22] Filed: Dec. 18, 1975

[21] Appl. No.: 641,977

[52] U.S. Cl. ..... 108/157; 108/90

[51] Int. Cl.[2] ..... A47B 3/06

[58] Field of Search ..... 108/157, 150, 90, 153, 108/151; 248/188.1

[56] References Cited

UNITED STATES PATENTS

| | | | |
|---|---|---|---|
| 826,669 | 7/1906 | Kindgen | 108/90 |
| 1,007,727 | 11/1911 | Onken | 108/90 |
| 1,203,752 | 11/1916 | Le Claire | 108/90 |
| 1,793,709 | 2/1931 | Meyers | 108/157 |
| 2,010,342 | 8/1935 | Woods | 108/157 |

*Primary Examiner*—Ramon S. Britts
*Assistant Examiner*—Darrell Marquette
*Attorney, Agent, or Firm*—Evelyn M. Sommer

[57] ABSTRACT

A table assembly having a top portion and a base portion which are secured together by supplying the base portion with a circular ring and the top portion with a plurality of clips supported on the bottom surface of the top portion by cross braces. The clips align with the circular ring of the base portion by sliding the top portion therealong whereby one of the clips is situated in the interior of the circular ring and the other clips are situated exteriorly of the circular ring. The clips are then secured to the bottom surface of the circular ring as by screws.

7 Claims, 7 Drawing Figures

TABLE ASSEMBLY

BACKGROUND OF THE INVENTION

The present invention is directed to a pedestal table for use outdoors and indoors and which must be shipped to a dealer from a supplier for subsequent sale.

Pedestal tables are well known and typically consist of a base portion of desired shape on which is mounted a top of circular, square or other shape. However, since the top of the table has been manufactured so as to be permanently attached to the base, the shipment and storage thereof has been a problem due to the awkward shape and size of the table.

SUMMARY OF THE INVENTION

It is, therefore, the primary object of the present invention to provide a pedestal table in which the top and base are capable of being separately shipped and stored, and which may be assembled at the dealers' location by a simple and easy method.

The table of the present invention has a base portion which provides a circular ring at its top. The top of the table, which may be circular or any other desired configuration, is provided with a plurality of clips which when slid horizontally along the circular ring of the base portion engage therewith and align the top of the table on the base portion.

BRIEF DESCRIPTION OF THE DRAWING

The invention will be more readily understood with reference to the following detailed description when taken in conjunction with the accompanying drawings, wherein.

DETAILED DESCRIPTION OF THE INVENTION

Figure 1:
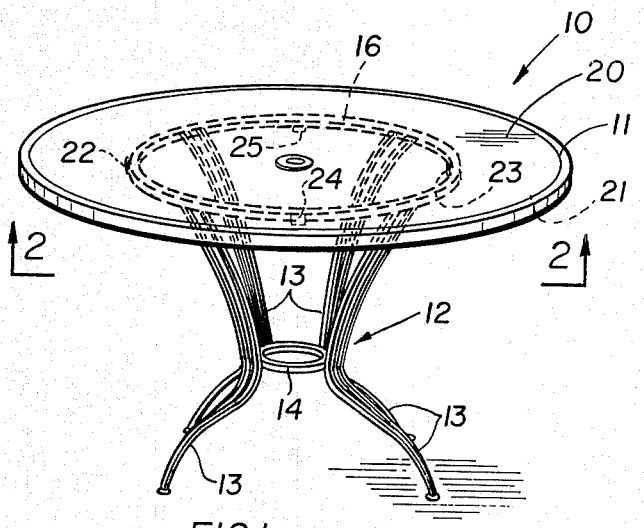
FIG. 1 is a perspective view of the pedestal table of the present invention.
Figure 2:
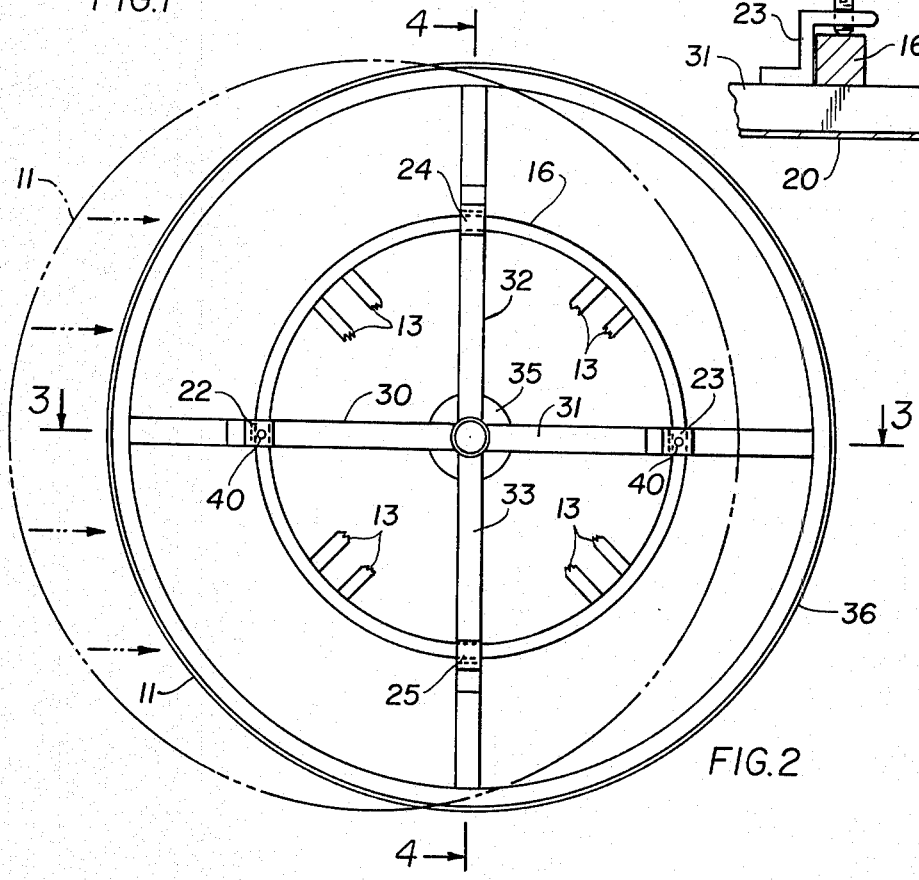
FIG. 2 is a plan view of the pedestal table of the present invention.

Referring now to the drawings, the pedestal table 10 of the invention is shown generally in FIG. 1. The table 10 has a top portion of circular cross-section, but it is to be understood that numerous other shapes may be used without departing from the scope of the invention. The top portion 11 is mounted on a base portion 12 which has a plurality of legs 13 connected by a circular member 14 at their midpoints. The top of each leg 13 supports a circular ring 16 (see FIG. 2) which may be attached by welding the circular ring to the top of the legs. The circular ring 16, which may be made of any suitable metal, provides an annular surface for the reception of clips (to be described below) on the top portion of the table 10.

Figure 3:
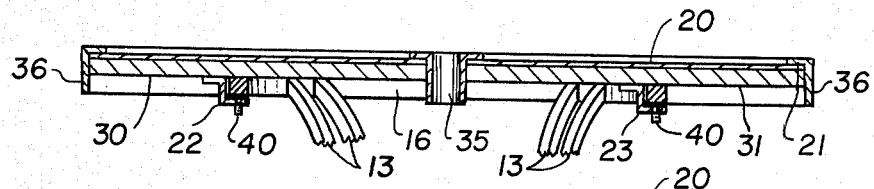
FIG. 3 is a cross-sectional view taken along line 3—3 of FIG. 2.
Figure 4:
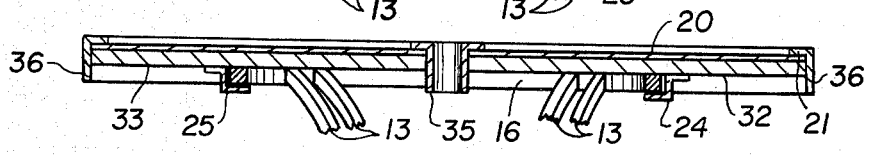
FIG. 4 is a cross-sectional view taken along line 4—4 of FIG. 2.

The top portion 11 has a supporting upper surface 20 and a rim member 21 which carries four clips 22, 23, 24 and 25. The clips are equiangularly spaced about the center of the top portion, each clip being separated from another by 90°. The clips 22 and 23 are mounted on cross braces 30 and 31, repectively, while the clips 24 and 25 are mounted on cross braces 32 and 33, respectively. The four cross braces are spanned between a circular joint 35 and the lip 36 of the top portion 11, the lip extending perpendicularly from the rim member 21. As can be seen from FIGS. 3 and 4, three clips 22, 24 and 25 are situated near the circular ring 16 along the outer and bottom surfaces thereof, while one clip 23 is situated near the circular ring on the inner and bottom surfaces thereof. That is, three clips are mounted relative to the circular ring 16 so that their vertically extending members are situated outside of the circular ring 16 while their horizontal members are below the bottom surface of the circular ring. The clip 23, on the other hand, has its vertical member situated on the interior of the circular ring 16 with its horizontal member extending from the vertical member to a position near the bottom surface of the circular ring. Such arrangement of the clips allows for the easy assembly of the pedestal table by merely placing the top portion 11 on the circular ring 16 of the base portion so that the clip 23 is situated in the interior of the circular ring 16. By simply pushing or pulling the top portion 11 in a horizontal direction so that all of the clips are moved toward the outer peripheral surface of the ring 16, the table will be assembled. To remove the top portion from the base portion, all that is required is that the top portion be pushed or pulled in the opposite horizontal direction thereby moving the clips away from the outer peripheral surface.

The vertical members of the three clips 22, 24 and 25 are spaced along their respective cross braces an equal distance from the center of the bottom surface of the top portion, thus forming a circular path having as its center the center of the bottom surface. The radius of this circular path as defined by the distance from the center to the inner surfaces of the vertical members is slightly larger than the outer radius of the circular ring as defined by the distance from the center of the ring to the outer peripheral surface. The clip 23, which is mounted on the cross brace 31 so that its vertical members are closest to the center of the bottom surface, is positioned along the cross brace 31 such, that its inner surface, which lies nearest to the circular ring, is approximately the same distance from the center of the bottom surface as the distance from the center of the circular ring to the inner peripheral surface of the circular ring.

Figure 5:
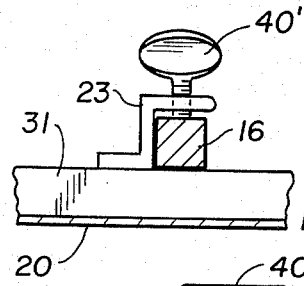
FIGS. 5, 6, and 7 are details showing different type of screws that may be used to attach the top of the pedestal table of the present invention to the base portion.
Figure 6:
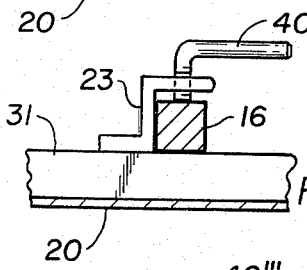
Figure 7:
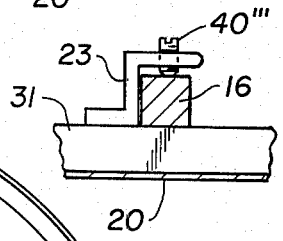

The clips 22 and 23 are secured to the circular ring 16 by screws 40. The clips 22 and 23 may be secured by a thumb screw 40' shown in FIG. 5; by a hooked screw 40'' shown in FIG. 6, by a notched screw 40''' turnable by a screw driver or screw with another type head. Each type of screw bears against the bottom surface of the circular ring 16 to firmly hold the parts together.

When using the pedestal table of the invention, the top portion 11 is placed on top of the base portion 12 so that the clip 23 is in the interior of the circular ring 16. Then the top portion 11 is pushed or pulled horizontally to the left in FIG. 2 from the position indicated in dotted line to the position indicated in solid line. When the clip 23 and other clips are properly aligned with the circular ring 16, a pair of screws 40', 40'' or 40''' are inserted to securely hold the table top portion to the bottom base portion. When disassembling the table, the screws are removed and the top portion is simply slid to the right in FIG. 2 and removed from the base portion. Thus simple alignment of the center of the top portion and the center of the base portion is achieved.

Although there has been shown four clips, it is to be understood that three clips may be used with accordingly three cross braces used for supporting the clips. In this instance, the clips and their respective cross braces are spaced 120° apart about the center of bottom surface of the top portion 11. Also, the table top portion 11 need not be of circular cross-section but may have a square, rectangular, or oval shape; it being understood that the clips and cross braces used would still have to be equiangularly spaced as illustrated.

Numerous other modifications may be had without departing from the scope and spirit of the invention; those embodiments disclosed being only suggestive.

What is claimed:

1. A table assembly comprising a top portion, base portion and means for securing said portions together; said bottom portion having a plurality of legs for supporting the table assembly and a circular ring mounted at the top of said plurality of legs, said circular ring having an inner radius measured from the center of said circular ring to the inner peripheral surface of said circular ring, and an outer radius measured from said center of said circular ring to the outer peripheral surface of said circular ring; said top portion having a bottom surface, a plurality of cross braces spaced equiangularly about the center of said bottom surface, and a plurality of clips, one clip being supported by one of said plurality of cross braces, whereby said top portion is assembled to said base portion by sliding the top portion along the circular ring until the clips are in flush engagement therewith, each of said clips including a vertical member extending perpendicular to its respective brace, and two horizontal members extending horizontally from said vertical member, each of said vertical members having an inner surface nearest said circular ring and an outer surface farthest from said circular ring; and one of said clips having an inner surface of its vertical member positioned on its respective cross brace a distance from the center of said bottom surface slightly less than said inner radius of said circular ring.

2. The table assembly according to claim 1, wherein said top portion further comprises a joint connecting all of said cross braces at the center of said bottom surface, said top portion having a downwardly extending lip, each of said plurality of clips extending from said joint to said lip.

3. The table assembly according to claim 2, wherein said top portion comprises four of said cross braces and four of said clips, said clips and cross braces being spaced 90 degrees from each other on a circular path on the bottom surface.

4. The table assembly according to claim 2, wherein said top portion comprises three of said cross braces and three of said clips, said clips and said cross braces being spaced 120 degrees from each other along a circular path on the bottom surface.

5. The table assembly according to claim 1, wherein the other clips have their respective outer surfaces of their vertical members positioned from the center of said bottom surface a distance slightly greater than said outer radius of said circular ring.

6. The table assembly according to claim 5, wherein said one clip has its vertical member positioned closer to said center of said bottom surface than its horizontal member, and the vertical members of the other clips are positioned farther from said center of said bottom surface than their respective horizontal members.

7. The table assembly according to claim 6, wherein said means for securing comprises at least two screws for fastening at least two of said clips to said circular ring, said at least two clips having a hole formed therein for the reception of said screws.

* * * * *